US009113675B2

(12) United States Patent
DeHaven et al.

(10) Patent No.: US 9,113,675 B2
(45) Date of Patent: Aug. 25, 2015

(54) ARTICLE OF FOOTWEAR

(71) Applicant: NIKE, Inc., Beaverton, OR (US)

(72) Inventors: Daniel B. DeHaven, Sherwood, OR (US); Benjamin J. Monfils, Beaverton, OR (US); Sara C. Novotny, Hillsboro, OR (US); Dylan S. VanAtta, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 190 days.

(21) Appl. No.: 13/910,288

(22) Filed: Jun. 5, 2013

(65) Prior Publication Data

US 2014/0360048 A1 Dec. 11, 2014

(51) Int. Cl.

| | |
|---|---|
| ***A43B 1/10*** | (2006.01) |
| ***A43B 23/02*** | (2006.01) |
| ***A43B 13/14*** | (2006.01) |

(52) U.S. Cl.

CPC ..... *A43B 23/0295* (2013.01); *A43B 13/141* (2013.01); *A43B 23/027* (2013.01); *A43B 23/0245* (2013.01)

(58) Field of Classification Search

CPC ..... A43B 23/0295; A43B 13/141; A43B 23/0245; A43B 23/0235; A43B 23/027; A43B 23/07; A43B 13/14; A43B 13/16; A43B 3/26

USPC ..... 36/83, 93, 97, 102, 103, 45, 55, 50.1, 36/114, 100, 101, 7.1 R

See application file for complete search history.

(56) References Cited

U.S. PATENT DOCUMENTS

| | | | | |
|---|---|---|---|---|
| 1,717,127 | A | 6/1929 | Toole | |
| 3,742,625 | A | 7/1973 | Famolare, Jr. | |
| 4,231,170 | A | 11/1980 | Griswold | |
| 4,908,963 | A | 3/1990 | Krajcir | |
| 5,271,130 | A * | 12/1993 | Batra | 24/714.6 |
| 5,410,822 | A | 5/1995 | Vaccari | |
| 5,996,257 | A | 12/1999 | Harrison | |
| 6,128,834 | A * | 10/2000 | Vecchiola et al. | 36/11.5 |
| 6,298,582 | B1 | 10/2001 | Friton et al. | |
| 6,389,715 | B1 | 5/2002 | Krajcir | |
| 6,539,647 | B2 | 4/2003 | Diaz | |
| 6,944,976 | B2 * | 9/2005 | Sapp | 36/72 R |
| 7,036,244 | B1 * | 5/2006 | Finch | 36/8.3 |
| D558,964 | S | 1/2008 | Truelsen | |

(Continued)

FOREIGN PATENT DOCUMENTS

DE 102008020890 10/2009

OTHER PUBLICATIONS

"Reebok The Armadillo Black Top Basketball Shoe White/White, Blue/Blue, Silver/Silver & Black/Black 2002," http://www.defynewyork.com/2012/06/27/reebok-the-armadillo-black-top-basketball-shoe-whitewhite-blueblue-blackblack-2002/, posted Jun. 27, 2012, downloaded on Sep. 9, 2013, 3 pages.

*Primary Examiner* — Khoa Huynh
*Assistant Examiner* — Carolyn W Davis
(74) *Attorney, Agent, or Firm* — Banner & Witcoff, Ltd.

(57) ABSTRACT

An article of footwear may include a plurality of segments. Each of the plurality of segments may form a portion of a combined upper and sole structure. A bootie may line the combined upper and sole structure. The bootie may interconnect the plurality of segments such that the plurality of segments are independently moveable with respect to one another.

20 Claims, 14 Drawing Sheets

(56) References Cited

U.S. PATENT DOCUMENTS

| | | | | |
|---|---|---|---|---|
| 7,562,470 | B2 | 7/2009 | Keen | |
| 7,814,686 | B2 | 10/2010 | Becker et al. | |
| 8,051,585 | B2 | 11/2011 | Hope et al. | |
| 2004/0205982 | A1* | 10/2004 | Challe | 36/55 |
| 2005/0241179 | A1* | 11/2005 | Chen | 36/3 A |
| 2007/0011914 | A1* | 1/2007 | Keen et al. | 36/50.1 |
| 2007/0107265 | A1 | 5/2007 | Mueller | |
| 2008/0216355 | A1* | 9/2008 | Becker et al. | 36/102 |
| 2009/0083993 | A1 | 4/2009 | Plank | |
| 2009/0217550 | A1 | 9/2009 | Koo | |
| 2009/0229144 | A1 | 9/2009 | Sussman | |
| 2009/0249653 | A1 | 10/2009 | Gunthel | |
| 2010/0325920 | A1 | 12/2010 | Ewans | |
| 2011/0035963 | A1* | 2/2011 | Baker et al. | 36/114 |
| 2011/0088283 | A1* | 4/2011 | Berthet et al. | 36/50.1 |
| 2011/0209359 | A1 | 9/2011 | Chen | |
| 2011/0308108 | A1 | 12/2011 | Berns | |
| 2012/0011744 | A1* | 1/2012 | Bell et al. | 36/91 |

* cited by examiner

ARTICLE OF FOOTWEAR

BACKGROUND

Conventional articles of footwear include two primary elements, an upper and a separate sole structure. The upper may provide a covering for the foot that securely receives and positions the foot with respect to the sole structure. The sole structure is secured to a lower portion of the upper and is generally positioned between the foot and the ground. In addition to attenuating ground reaction forces, the sole structure may provide traction, control potentially harmful foot motion, and support the bottom of the foot and the arch. The upper and the sole structure should cooperatively provide a comfortable structure that is suited for a wide variety of ambulatory activities, such as walking and running.

The upper forms a void on the interior of the footwear for receiving the foot. The void has the general shape of the foot, and access to the void may be provided by an ankle opening. The upper typically extends over the instep and toe areas of the foot, along the medial and lateral sides of the foot, and around the heel area of the foot. A lacing system is often incorporated into the upper to selectively increase the size of the ankle opening and permit the wearer to modify certain dimensions of the upper, particularly girth, to accommodate feet with varying proportions. In addition, the upper may include a tongue that extends under the lacing system to enhance the comfort of the footwear, and the upper may include a heel counter to limit movement of the heel.

The sole structure of conventional articles of footwear may incorporate multiple layers that are conventionally referred to as an insole, a midsole, and an outsole. The insole may be a thin, comfort-enhancing member located within the upper and adjacent the plantar (lower) surface of the foot to enhance footwear comfort. The midsole, which is traditionally attached to the upper along the entire length of the upper, forms the middle layer of the sole structure and may serve a variety of purposes such as control of foot motions and attenuation of ground reaction forces. The outsole may form the ground-contacting element of footwear and can be fashioned from a durable, wear-resistant material that includes texturing to improve traction.

SUMMARY

This Summary is provided to introduce a selection of concepts in a simplified form that are further described below in the Detailed Description. This Summary is not intended to identify key features or essential features of the invention.

Aspects of the disclosure herein involve a footwear structure comprising a plurality of disjointed segments, which forms an outer cover. Each of the plurality of segments can form a portion of a combined upper and sole structure of the footwear. A flexible bootie may line the outer cover formed by the segments. The bootie can also interconnect the plurality of segments such that the plurality of segments are independently moveable with respect to one another to provide for a more flexible footwear that provides for additional dorsiflexion, plantar flexion, and other foot motion.

In another aspect, a method of forming a footwear structure is disclosed. The method may include providing a plurality of segments to form a combined upper and sole structure of the footwear. The method can further include securing the plurality of segments to a flexible bootie structure that forms an inner liner in the combined upper and sole structure, and interconnecting the plurality of segments with the bootie structure such that the plurality of segments are independently moveable with respect to one another.

BRIEF DESCRIPTION OF THE DRAWINGS

The foregoing Summary, as well as the following Detailed Description of Example Embodiments, will be better understood when read in conjunction with the accompanying drawings.

DETAILED DESCRIPTION

Figure 1A:
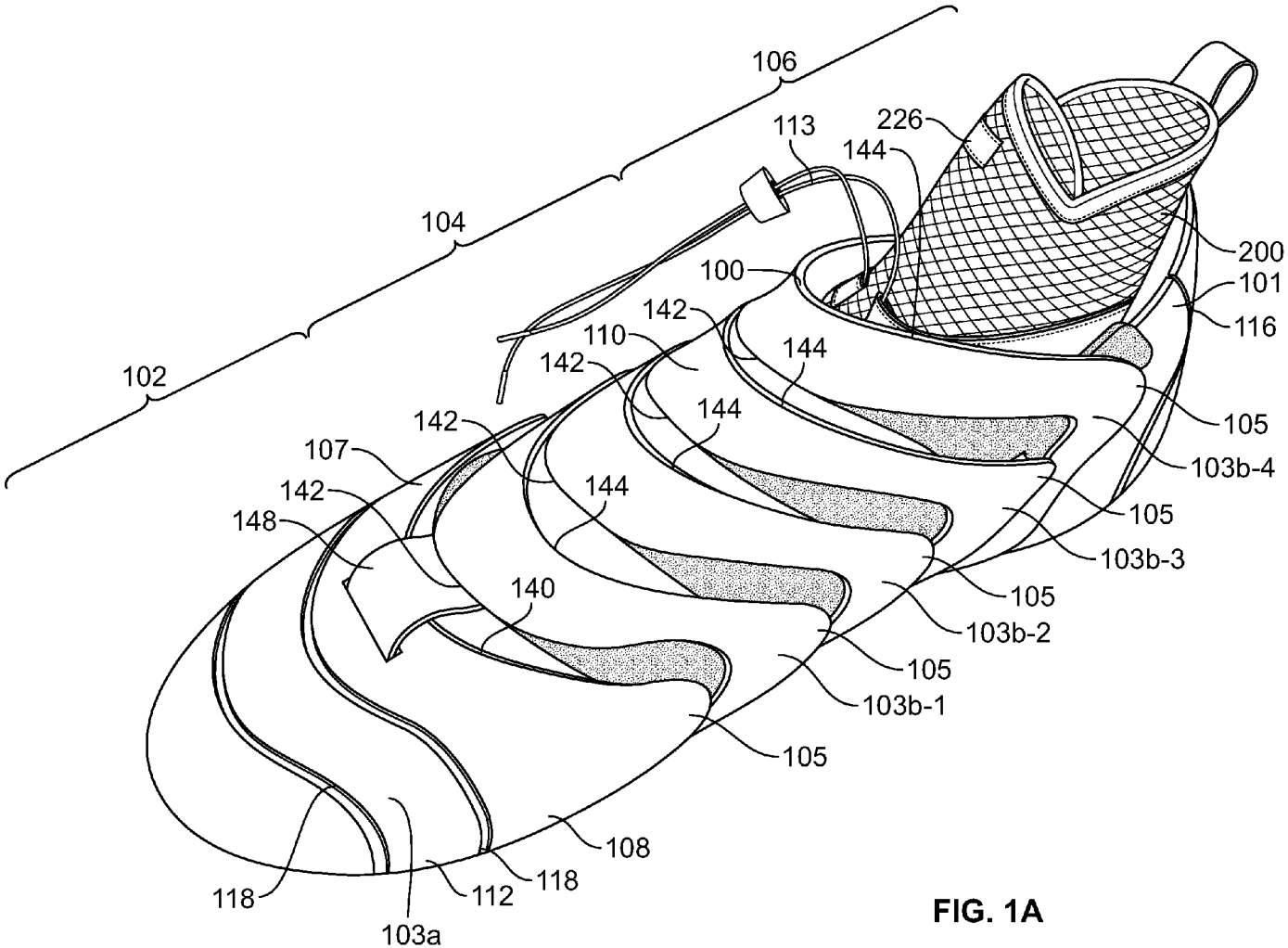
FIG. 1A is a top medial perspective view of an article of footwear according to one embodiment.

In the following description of various example structures, reference is made to the accompanying drawings, which form a part hereof, and in which are shown by way of illustration various structures and environments in which aspects of the invention may be practiced. It is to be understood that other structures and environments may be utilized and structural and functional modifications may be made to the described features without departing from the scope of the present invention. Embodiments of the invention may include other structures and/or otherwise be practiced or carried out in various alternate ways. Also, it is to be understood that the phraseology and terminology used herein are for the purpose of description and should not be regarded as limiting. Rather, the phrases and terms used herein are to be given their broadest interpretation and meaning. The use of "including" and "comprising" and variations thereof is meant to encompass the items listed thereafter and equivalents thereof, and is not intended to exclude the presence of other items not specifically listed. The use of the terms "mounted," "connected," "coupled," "positioned," "engaged" and similar terms, is meant to include both direct and indirect mounting, connecting, coupling, positioning and engaging.

The following discussion and accompanying figures disclose an article of footwear having a plurality of interconnected segments together forming a combined upper and sole structure of the footwear. Concepts related to the interconnected segments are disclosed with reference to footwear having a configuration that is suitable for various athletic activities, including, for example, running, training, basketball, football, and skateboarding. This disclosure is not solely limited to articles of footwear designed for these activities, however, and it may be applied to a wide range of athletic footwear styles that includes but is not limited to: walking shoes, hiking shoes and boots, tennis shoes, volleyball shoes, soccer shoes, and golf shoes.

In addition to athletic footwear, concepts related to the present disclosure may be applied to footwear that is generally considered to be non-athletic (e.g., dress shoes, sandals, and work boots) or footwear serving a medical or rehabilitative purpose. Accordingly, one skilled in the relevant art will appreciate that the concepts disclosed herein apply to a wide variety of footwear styles.

In one aspect, a plurality of disjointed segments forms an outer covering for an article of footwear. The plurality of segments forms a combined upper and sole structure of the footwear. The formation of the upper and the sole structure from these segments provides a high degree of flexibility to the footwear, while providing a high level of comfort and protection to the user's foot. In particular, each of the segments may overlap each other and the individual segments are permitted to articulate with respect to one another in a lengthwise direction so as to permit dorsiflexion, plantar flexion, and other foot motion.

A flexible bootie structure lines the combined upper and sole structure, e.g., to provide a comfort structure for receiving a wearer's foot. The bootie structure may interconnect the plurality of segments forming the outer cover such that the plurality of segments are independently moveable with respect to one another on the upper structure and on the sole structure of the footwear. The segments and the bootie together provide a simple and lightweight footwear structure that allows the user's feet to move more naturally and freely than traditional athletic shoes.

Figure 1B:
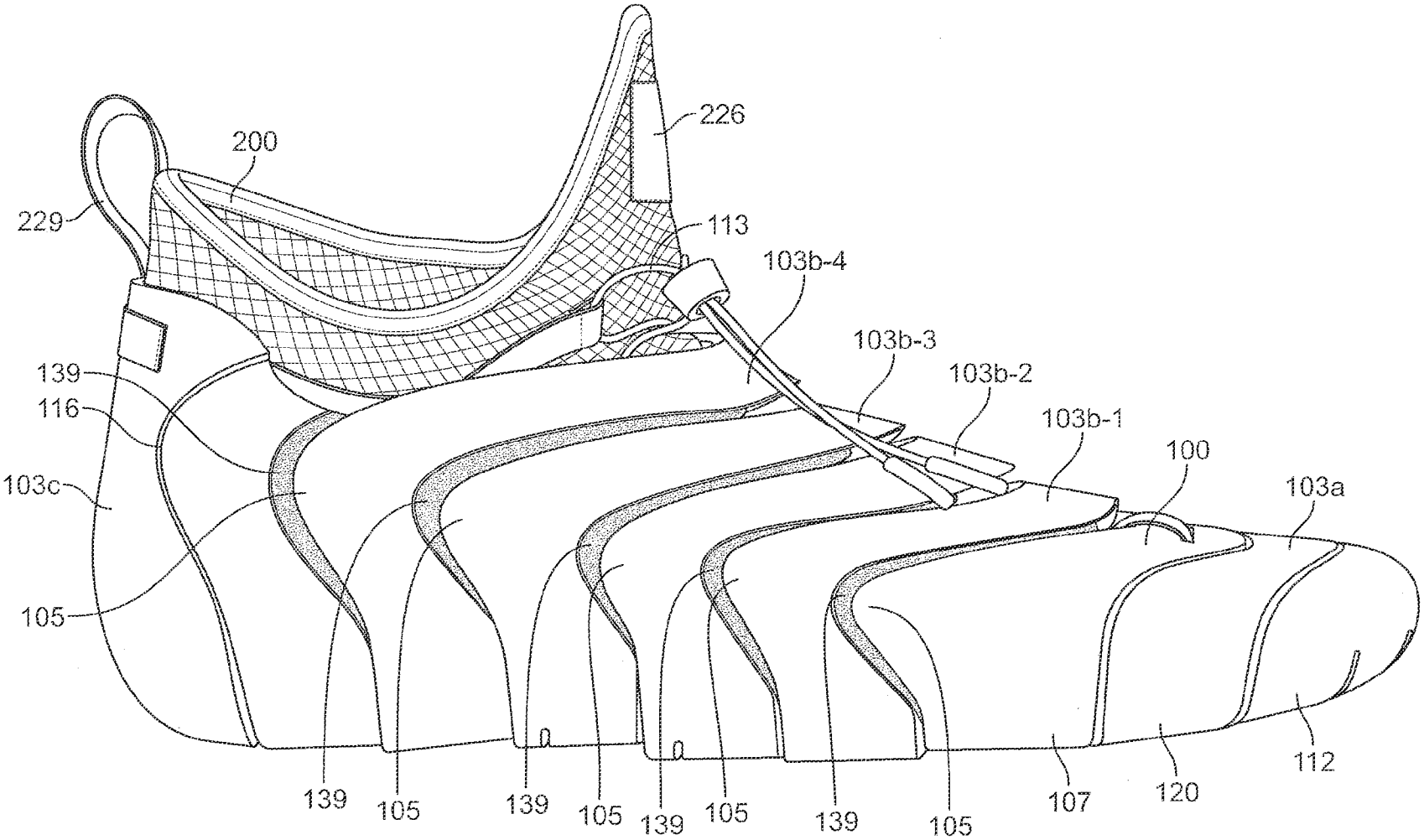
FIG. 1B is a lateral side view of the article of footwear of FIG. 1A.

The following discussion and accompanying figures disclose an article of footwear 100 in accordance with various aspects of the present invention. FIG. 1A is a top medial perspective view of an article of footwear (or "footwear") 100. FIG. 1B is a lateral side perspective view of footwear 100. Footwear 100 is a right foot shoe and is part of a pair of shoes that includes a left foot shoe (not shown) that is a mirror image of footwear 100. Aspects of footwear 100 provide much directional flexibility along the length of the foot and in the transverse directions to provide enhanced degrees of freedom in the footwear and to provide to permit dorsiflexion, plantar flexion, and other foot motion. Movement of the foot and other components of footwear 100 are described herein as movement in particular directions. However, it is understood that the term direction can refer to rotational movements, linear movements, combinations thereof, or other descriptors of movement.

For reference purposes, footwear 100 may be divided into three general regions as shown in FIG. 1A: a forefoot region 102, a midfoot region 104, and a heel region 106. Regions 102-106 are not intended to demarcate precise areas of footwear 100. Rather, regions 102-106 are intended to represent general areas of footwear 100 that provide a frame of reference for the following discussion. Although regions 102, 104, 106 apply generally to footwear 100, references to regions 102, 104, 106 may also apply specifically to the outer covering 101 and/or to bootie 200.

Disjointed segments 103*a*, 103*b*-1, 103*b*-2, 103*b*-3, 103*b*-4, and 103*c* (collectively "103") form the outer covering 101. Each of the plurality of segments 103 cooperates to form an outer covering 101. The outer covering 101 acts as a combined upper and sole structure. The combined upper and sole structure includes portions of segments 103 that effectively form an upper 110 and portions of segments 103 that effectively form a sole structure 112. In particular, each of the segments 103 can include an upper portion, a pair of side portions, and a bottom portion and each of the side portions can include a rearward section and a forward section. The upper portions, the side portions, and the bottom portions can together define a combined upper and sole structure.

Each of the segments 103 defines a space bounded by the segment, and the segments 103 are arranged such that the spaces define a generally foot-shaped interior volume. Bootie 200 occupies the generally foot-shaped interior volume or void within outer covering 101. The bootie 200 is contained within and lines the foot-shaped interior volume of the article. The bootie 200 also interconnects the plurality of segments 103. The interconnected plurality of segments 103 are independently moveable with respect to one another.

A tongue-like portion 226 can also be formed on the bootie 200. The lateral side 107 extends along each of regions 102-106 and is generally configured to cover a lateral portion of the user's foot. In addition, the lateral side 107, the medial side 108, and the tongue-like portion 226 cooperatively form an ankle opening in heel region 106 to provide the user's foot with access to the void within the upper 110.

Figure 1C:
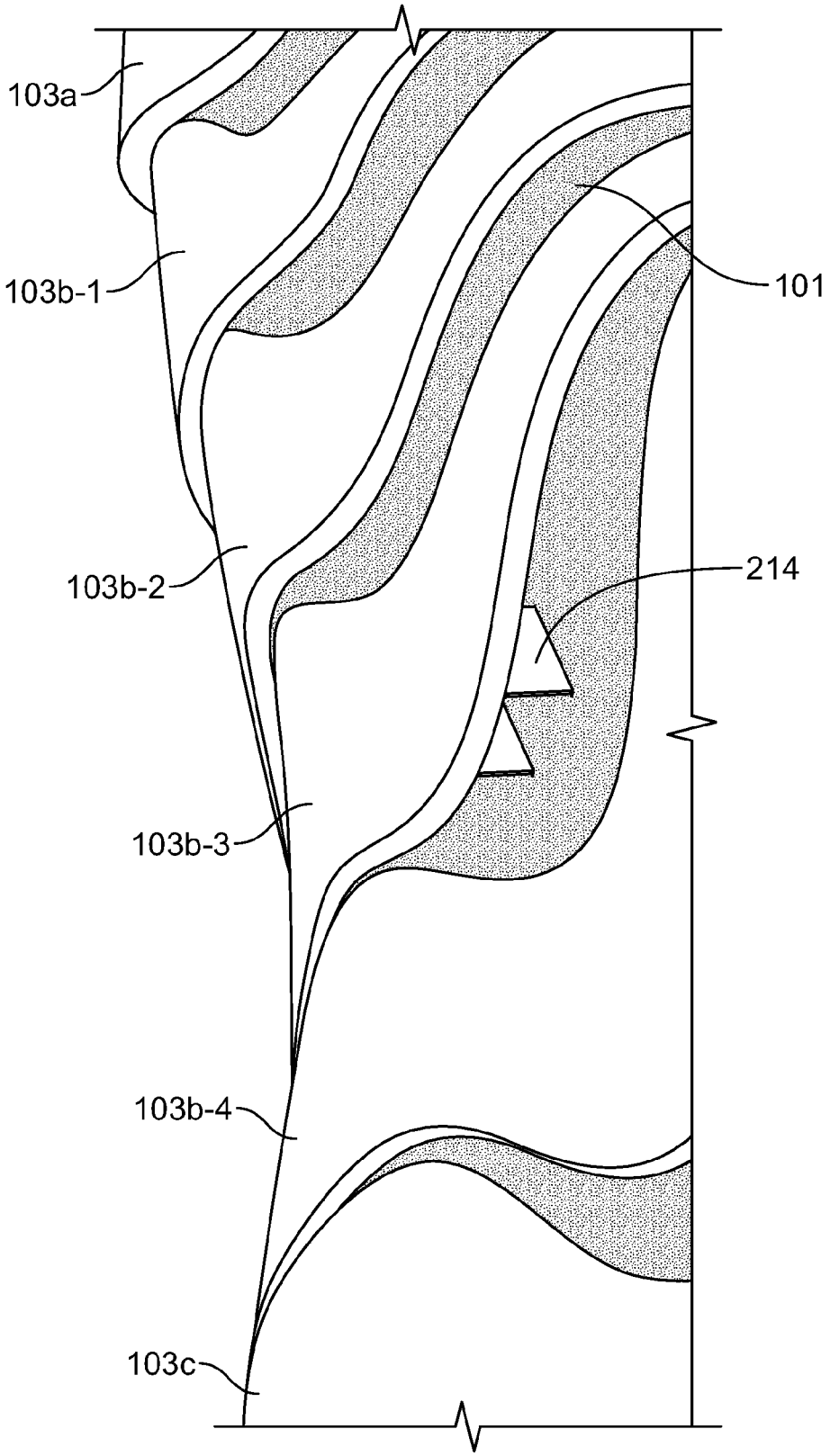
FIG. 1C is a partial rear view of a portion of the article of footwear of FIG. 1A.
Figure 2A:
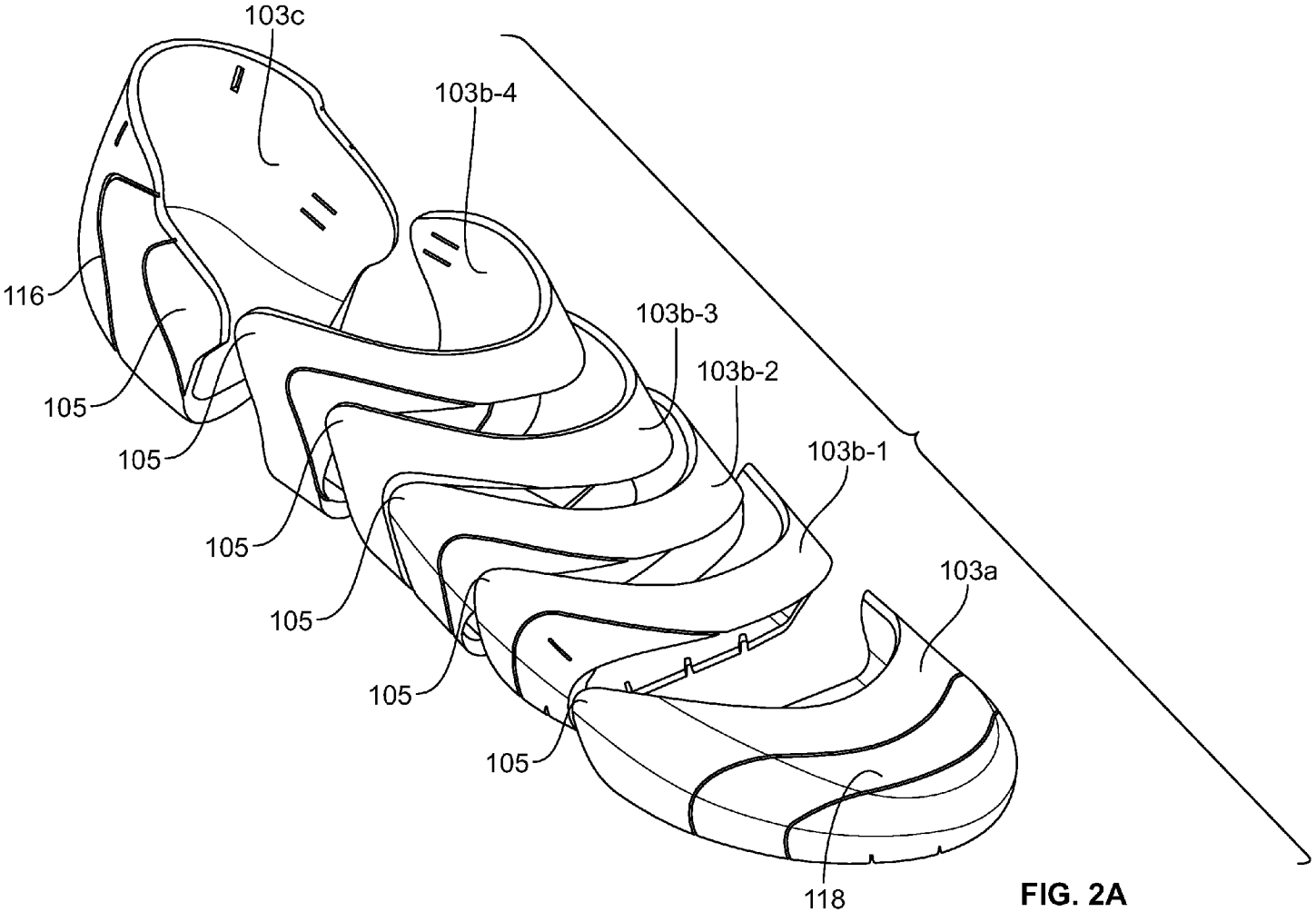
FIG. 2A is a top partially exploded lateral perspective view of exemplary segments that form the footwear of FIG. 1A.
Figure 2B:
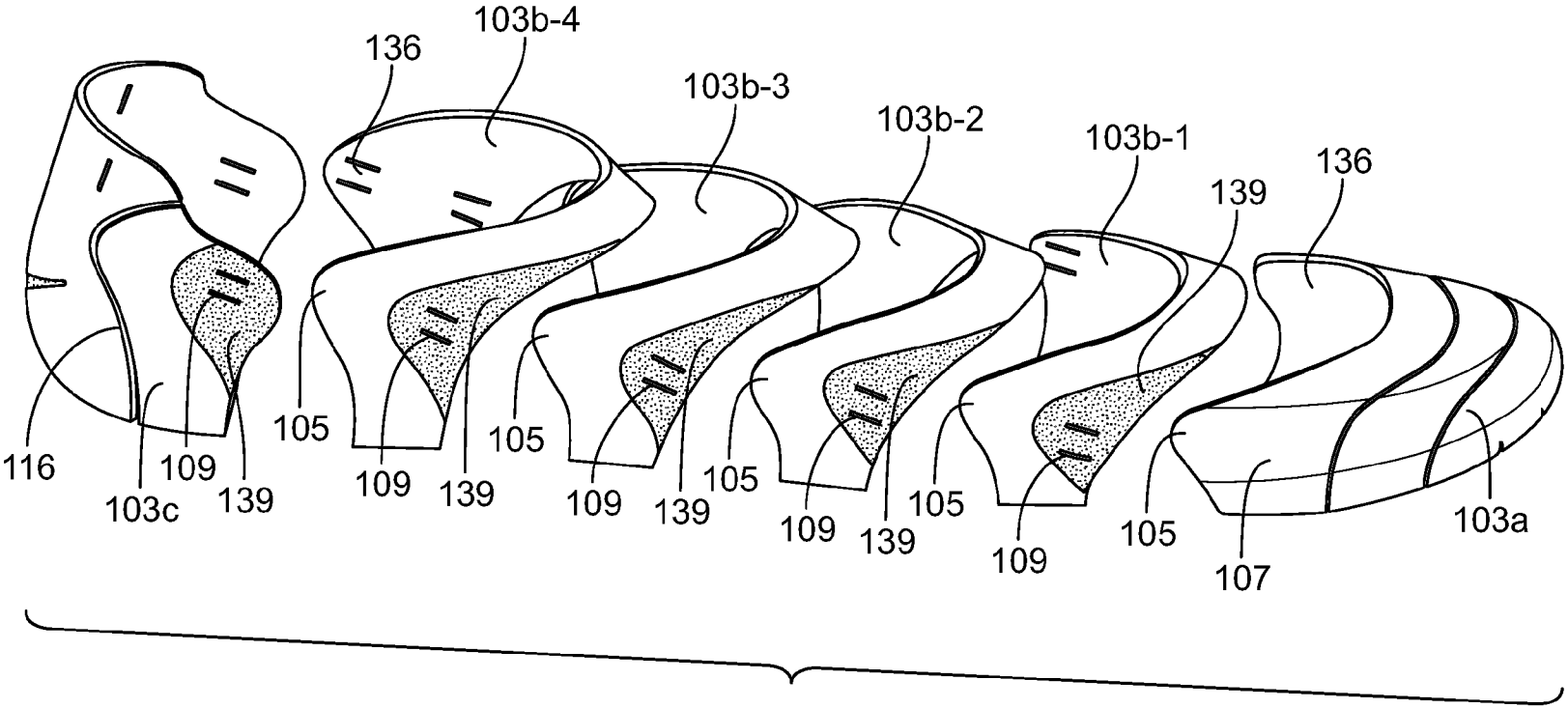
FIG. 2B is a partially exploded lateral side view of exemplary segments that form the footwear of FIG. 1A.
Figure 2C:
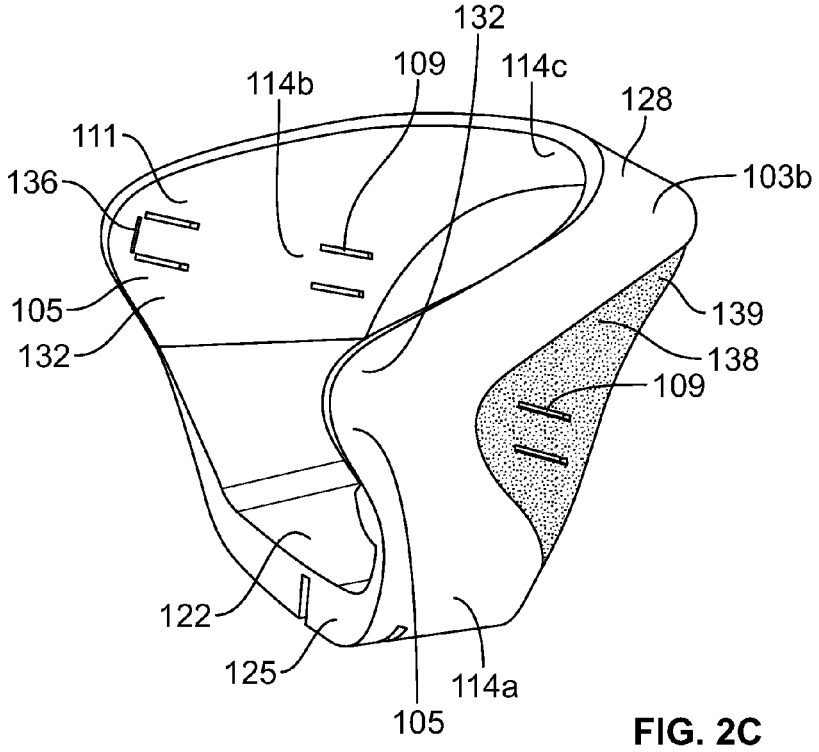
FIG. 2C is a lateral side view of an exemplary segment that may form the footwear of FIG. 1A.

FIGS. 1A-1C depict assembled views of footwear 100 formed of the plurality of segments 103 and bootie 200. FIG. 1C is a partial rear view of a portion of the outer covering 101. FIGS. 2A-2C generally depict the individual segments 103 that form the outer covering 101 of the footwear 100. The footwear 100 also includes a liner or bootie 200, which is described in more detail herein, for receiving the user's foot and for securing the segments 103 together. As shown in FIGS. 1A and 1B, the plurality of segments 103 are fastened to one another to form the outer cover 101.

As described in more detail below, each of the individual segments 103 could be molded and then secured together using straps 214-1, 214-2, 214-3, and 214-4 (collectively "214") on the bootie 200. Additionally, as described in more detail below, the bootie 200 can be glued to the inner insole foot bed 122 formed by interior bottom portions of the individual segments 103. In this way, the structure of the bootie 200 holds each of the segments 103 in place to form the footwear 100.

FIGS. 2A and 2B depict an exploded view of outer covering 101 and shows each of the segments 103. FIG. 2C shows an example of an individual segment 103*b*. In this example, the outer covering 101 of the footwear 100 can be formed with six segments 103. In particular, the outer covering 101 includes a toe segment 103*a*, four inner segments 103*b*-1, 103*b*-2, 103*b*-3, 103*b*-4 (collectively "103*b*"), and a heel segment 103*c*. However, it is contemplated that more or less segments 103 can be used to form the footwear 100 depending on the desired sizing of the footwear.

As shown in FIGS. 2A and 2B, a toe segment 103*a* can include an enclosed portion to protect the user's toe region, and the heel segment 103*c* can include an enclosed portion for protecting at least part of the user's heel and ankle region. Additionally, as shown in FIG. 1A, the toe segment 103*a* can be configured to receive a toe strap 148 as described in more detail below located on the bootie 200 for securing the toe segment 103*a* to the bootie 200. The heel segment 103*c* inner enclosed portion can be formed to accommodate the user's heel and rear ankle region. As discussed in more detail below, the inner segments 103*b* can each be formed of individual continuous loops of material to accommodate the user's foot.

The outer bottom portions of the segments 103 forms the tread 120 of the footwear 100. The bottom portions of segments 103 can be formed with a thicker region forming an inner foot bed surface 122. The inner foot bed surface 122, which is formed thicker than the remainder of the inner segments 103 can provide for additional impact force attenuation to the user's foot. The thickness of each segment 103 can taper from the inner foot bed surface 122 to the side portions 132 of the segments 103. The top portions 128 of the segments 103 can be formed from a thin strip of elastic material to provide for additional flexibility of the segments 103 and ultimately the footwear 100. This may assist the user in placing the footwear 100 onto the user's foot. Additionally, although not explicitly shown, the toe segment 103*a* and the heel segment 103*b* can be provided with a thicker portion to form toe and heel sole regions of the footwear 100 to provide for additional impact force attenuation to the user's foot.

The heel segment 103*c* can also include a sipe or multiple sipes 116 extending in both horizontal and vertical directions to provide for additional flexing and the desired articulation in the heel segment 103*c*. Likewise, the toe segment 103*a* can be formed to accommodate the user's toe region and can include multiple sipes 118 to provide for additional flexing and the desired articulation in the toe segment 103*a*. It is contemplated that any number of sipes can be provided on any of the segments 103 to provide for the desired flexing of the footwear 100.

The segments 103 can be formed with multiple curves in order to mesh with each other and make up the upper 110 and the sole structure 112. As shown in FIGS. 1A and 1B, the toe segment 103*a* can be formed with a concave portion 140 in a top region of the upper 110. Each of the segments 103*b* can each include a forwardly curved or convex portion 142 and a rearwardly curved or concave portion 144 along the upper 110. The convex portion 142 of the segment 103*b* adjacent to the toe segment 103*a* can be received in or near the concave portion 140 of the toe segment 103*a*. The concave portion 144 of each segment 103*b* can provide a recess for receiving an adjacent convex portion 142 of an adjacent segment 103*b*, with the exception of the segment 103*b* nearest to the tongue 226, where the concave portion 144 forms part of the opening for receiving the user's foot in conjunction with the opening in the bootie 200. Other arrangements of curvature and methods for providing meshing and the desired rotation and flexing of the segments 103 are contemplated. The arrangement of the segments 103 provides for dorsiflexion and planar flexion of the footwear 100.

As shown in FIGS. 1A and 1B, on both the lateral and medial sides of the outer covering 101, the side portions 132 of the segments 103*b* can be formed with rearwardly extending and curved flanges 105 that overlap an adjacent segment 103. As seen in FIG. 2C, each flange 105 on both the lateral and medial side includes inner connection surfaces 111 for receiving a corresponding front surface 138 of an adjacent segment 103*b* to provide for overlapping contact between the segments 103. As shown in FIG. 2C, for each of the segments 103*b*, the top portion 128, the pair of side portions 132, and the bottom portion 125 form the segment 103*b*. The side portions 132 comprise a rearward section and a forward section. The top portions 128 and the side portions 132 of the plurality of interconnected segments 103 define the upper 110 of the combined upper and sole structure, and the bottom portions 125 of the plurality of interconnected segment, define the sole portion 112 of the combined upper and sole structure. In addition, the side portions 132 of the segments 103 can each comprise a lower section 114*a*, a middle section 114*b*, and an upper section 114*c*. The middle section 114*b* extends in a rearward direction from the lower section 114*a*, and the upper section 114*c*.

As shown in FIG. 2C, the inner connection surfaces 111 can be formed with inner parallel slots 136 formed on an inner surface on each side portion 132 in the middle section 114*b* of the segments 103*b*. The slots can be formed as a uniform opening in the side portions such that straps 214 can extend entirely within the segment 103*b*. The inner parallel slots 136 can be configured to receive the straps 214 to secure the flanges 105 to an outer front surface 138 of a corresponding segment 103*a*. The front surface 138 of each segment 103 can be provided with open parallel slots 109 also on the middle section, which extend through each segment and receive straps 214 of the bootie 200 as described in further detail below.

Additionally although not shown, the toe segment 103*a* can include an inner connection surface and inner parallel slots located on the inner connection surface. The toe segment 103*a* can also include a recess for receiving a toe strap 148 for securing the toe segment 103*a* to the front portion of the bootie 200.

As shown in FIG. 1B, the plurality of segments 103 can be secured together at flanges 105 and curved notched portions 139 on each segment 103 using a cloth material or straps 214, which is described in more detail herein below. Specifically, as shown in FIGS. 2A and 2B, the curved notched portions 139 are formed as indentations corresponding to the shape and size of the curved flanges 105. The segments 103 are, thus, secured together using the curved notched portions 139 and the corresponding curved flanges 105. The curved flanges 105 rest within the curved notched portions 139 on each adjoining segment 103. In this way, each of the plurality of segments 103 can move substantially independent of one another and during use can articulate about their respective flanges with each respective notch.

The front surfaces 138 of each of the segments 103*a* and 103*c* can be formed with a notched curved portion 139 on the side portions 132 to receive the curved flanges 105 of an adjacent segment 103. These notched curved portions 139 provide for a location on each of the segments 103 to receive an adjacent segment 103 and for the curved flange 105 of the adjacent segment to articulate. The notched curved portions 139 assist in maintaining the relative locations of the segments 103 on the footwear 100 during the use of the footwear 100.

Figure 1D:
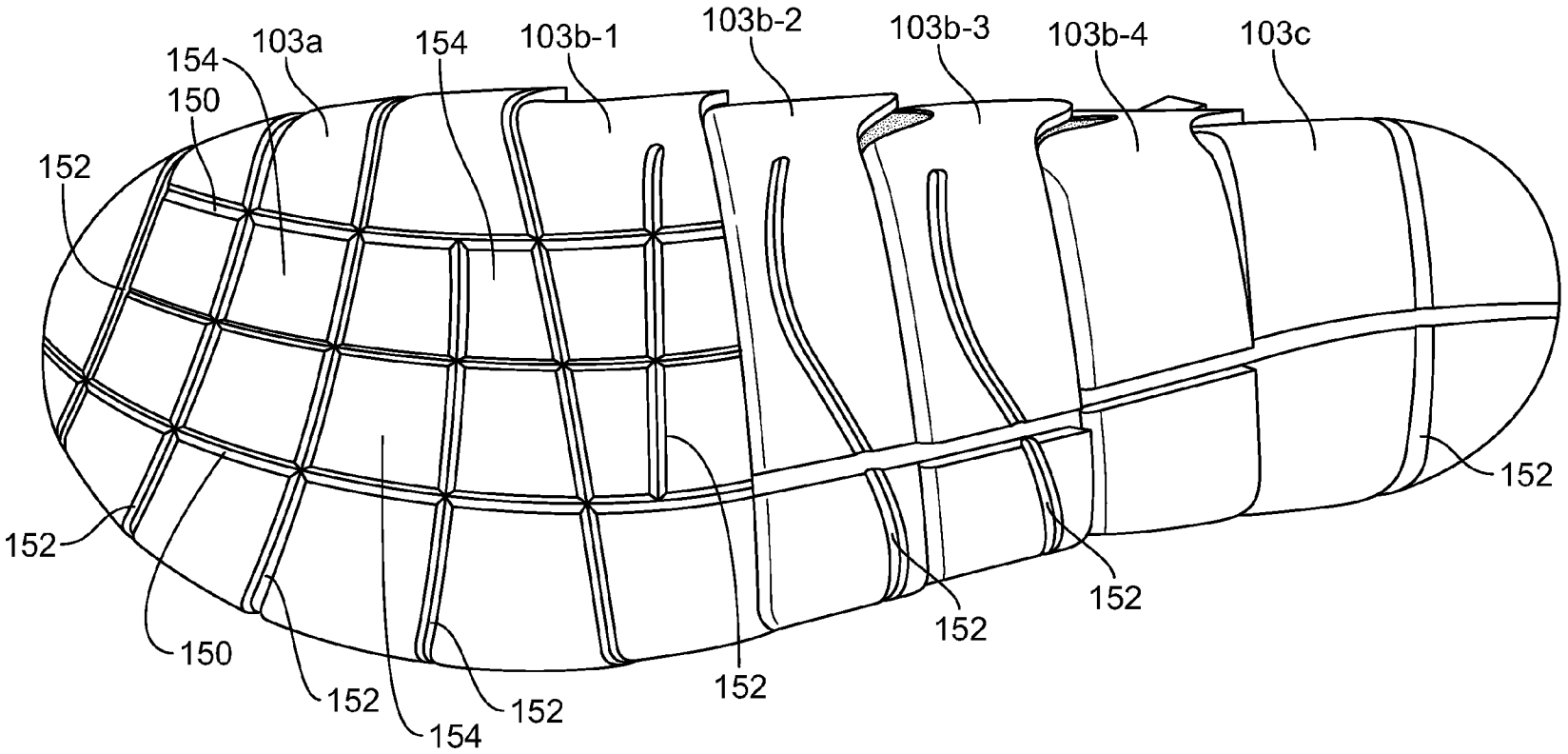
FIG. 1D is a bottom view of the article of footwear of FIG. 1A

FIG. 1D is a bottom view of the footwear 100 and shows the portions of segments 103 that form the sole structure 112. As shown in FIG. 1D, the sole structure 112 is formed of overlapping segments such that there are no openings between the segments on the sole structure 112. Additionally separate material inserts (not shown) such as rubber can be glued to the bottom of the segments on the sole structure 112 to provide for additional traction and durability to the footwear 100.

The sole structure 112 of the outer covering 101 can include several sipes 150, 152 to provide for the desired articulation in the footwear. Eight transverse sipes 152 that extend at least partially between the lateral and medial sides of the footwear 100 can be provided across the sole structure formed by the plurality of segments 103. The sipes 152 can be individually formed in one or more of the segments 103. Three longitudinal sipes 150 can extend lengthwise along the sole structure 112 and can be formed when each of the segments 103 are put together and formed into the footwear structure. The sipes 150, 152 help to create a structure that imparts relatively high flexibility and articulation of the footwear 100. In particular, sipes 150, 152 define a plurality of elements 154 on the sole structure 112. By flexing along sipes 150, 152, elements 154 can separate and move away from one another as a wearer walks, runs, etc. Other siping patterns can also be used and are also contemplated depending on the activity and/or size of the user.

Figure 2D:
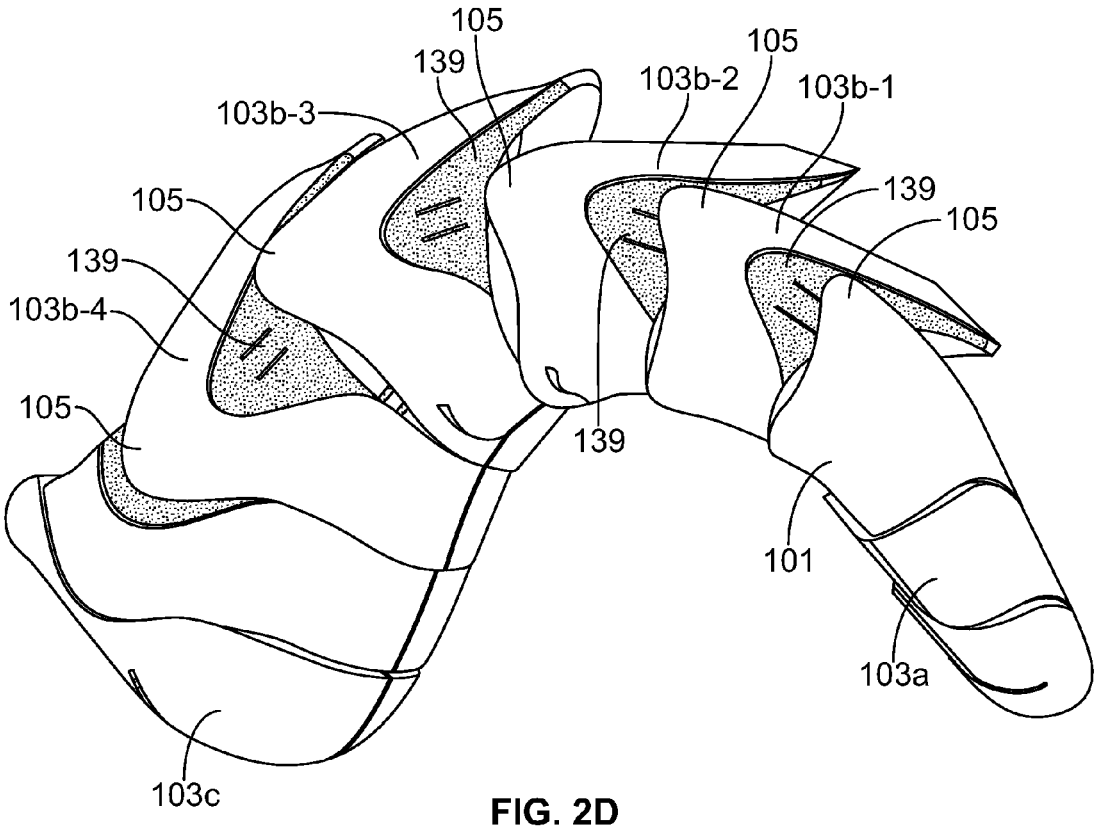
FIG. 2D depicts the flexing of segments forming the footwear.

FIG. 2D depicts the segments 103 in an extreme state of planter flexion. As shown in FIG. 2D, the arrangement of the plurality of segments 103 provide for a very flexible outer covering 101 in that the footwear 100 can articulate in the manner shown such that the segments 103 are free to move substantially independent of one another. The segments while being flexible relative to each other are also configured to protect the user's foot.

The segments 103 can be formed to have different stiffness and feel depending on the desired characteristics of the shoe. In one example, the segments can be formed to mimic the properties of a standard shoe formed of a separate upper and sole structure (e.g. a flexible upper and a stiff sole structure). This can be accomplished by forming the segments 103 thickest at the bottom near the portions of the segments 103 forming the sole structure 112 and thinner in the sections forming the upper section 110.

The plurality of segments 103 can be formed of urethane, durable skin foam, or rubberized foam. The material selected for forming the segments 103 can be selected based on the desired properties for the footwear. For example, forming portions of the segments 103 of a foam material is good for impact force attenuation in the sole structure 112, and forming portions of the segments 103 of a rubber material can provide for thinner segments 103. Additionally, a rubber material might provide for more of a "barefoot" type running feel. As discussed below in relation to alternative embodiments, the segments 103 can also be formed of different materials. Additionally, more than one material can form the same segment to form segments having varying durometers. The segments 103 can be formed individually by injection molding, casting, or compression molding or by a combination of the above processes. Each of the segments can be formed individually and can be formed as 360 degree segments 103 as is shown in FIG. 2C. Additionally, the parallel slots 109 and the inner slots 136 can be formed into the segments 103 by using circular or curved metal or plastic inserts within the mold structure during formation of the segments 103.

To accommodate different sized feet, and to reduce the number of needed molds, three different sized molds may be used that form three different sized segments. Using different combinations of these three different sized segments, most footwear sizes can be accommodated. This may help simplify the manufacturing process by reducing the number of molds needed to form different sized footwear.

A variety of materials are suitable to form the segments 103. Depending on the desired properties of the outer covering 101 and footwear 100, the segments 103 may be formed from combinations of leather, synthetic leather, natural or synthetic textiles, polymer sheets, polymer foams, mesh textiles, felts, non-woven polymers, or rubber materials, for example. In one example, the portions of the segments 103 forming the sole structure 112 may be formed of a tough leather, a synthetic leather, or a rubber material that imparts a relatively high degree of wear-resistance, whereas portions of the segments 103 forming the upper 110 may be formed of a textile material that provides greater flexibility or air-permeability.

Figure 3A:
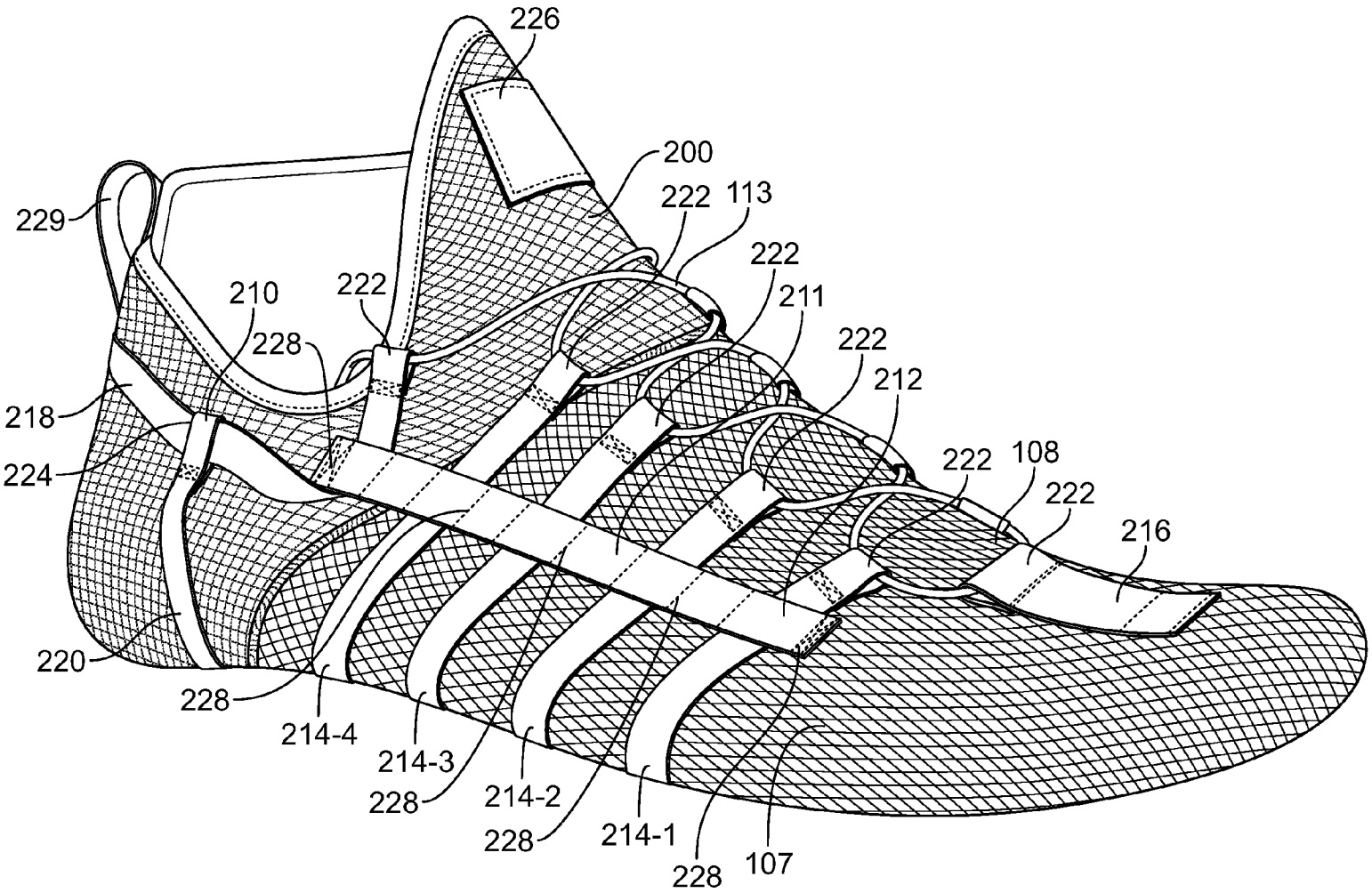
FIG. 3A is a lateral perspective view of an example bootie that can be used in conjunction with the segments of FIGS. 2A and 2B to form the footwear of FIG. 1A.
Figure 3B:
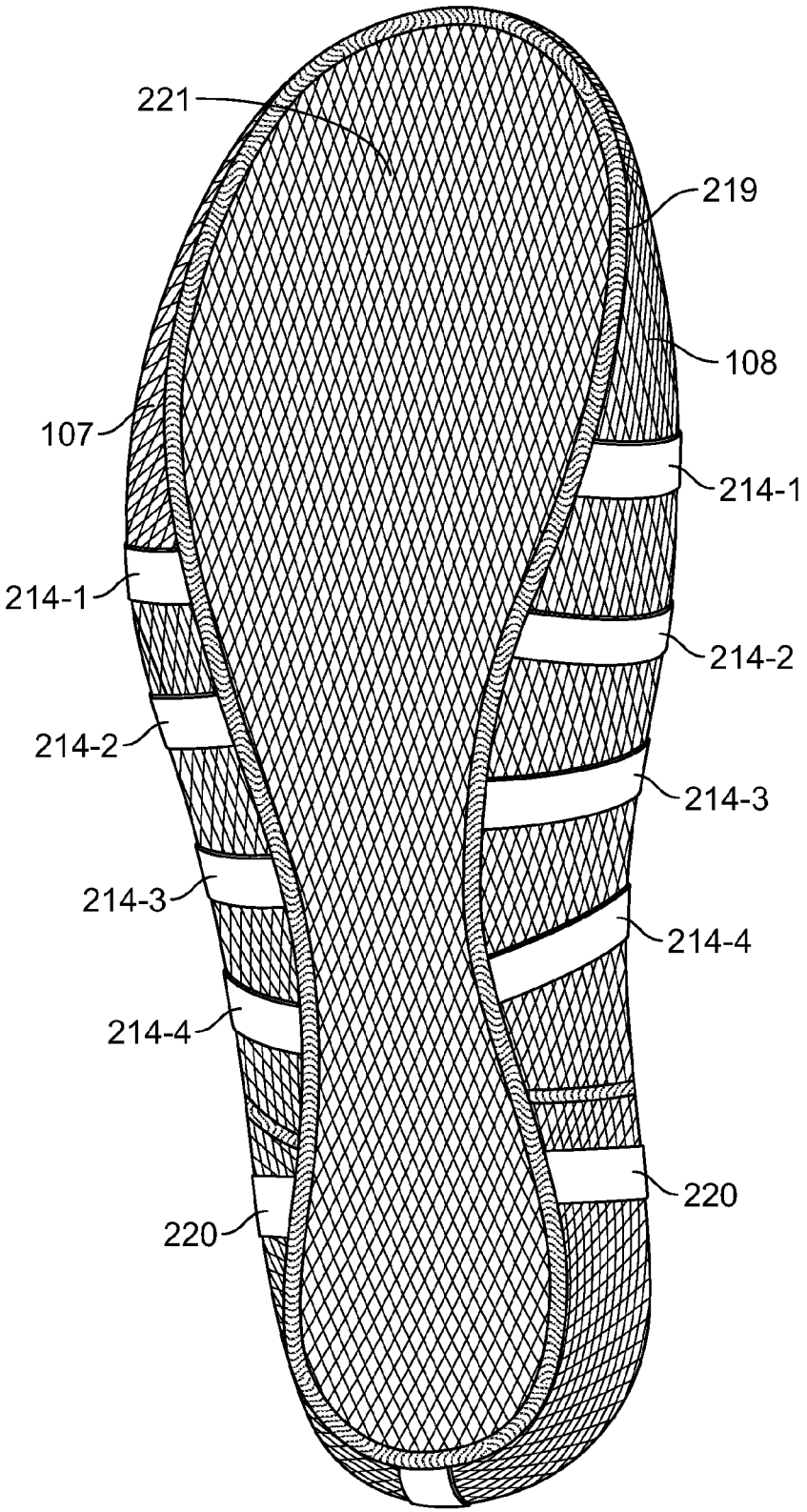
FIG. 3B is a bottom view of the example bootie of FIG. 3A.

FIG. 3A shows a lateral perspective side view of an example bootie 200, and FIG. 3B shows a bottom view of the example bootie 200 in FIG. 3A. The bootie 200 lines the outer covering 101 as shown, for example, in FIGS. 1A and 1B. The bootie 200 can be secured to the inside of the outer covering 101 using a suitable adhesive, stitching, or otherwise fixing the bootie 200 to an inside area of the segments 103. In one example, the bottom of the bootie 200 is adhesively secured to the inner foot bed surfaces 122 of the segments 103, and, as described herein, the straps 214, 218 can be weaved through the parallel slots 109 and the inner slots 136 of the segments 103 on both the lateral side 107 and the medial side 108 of the segments 103 to assist in securing the segments 103 to the bootie 200. As discussed herein, each of the straps 220 and 214 can be weaved through outer parallel slots 109 and the inner parallel slots 136 on each the individual segments 103. A toe strap 148 may also be provided for securing the toe segment 103*a* to the front portion of the bootie 200.

The bootie 200 can be formed of any suitable material, such as a mesh, textile, or knit material, to provide the wearer with a desired level of comfort. In one example, the bootie 200 may be made of a lightweight material or a netting material, such as an elastic mesh material, which can be an opaque or semi-transparent material. Different kinds of mesh are contemplated depending on the desired properties of the footwear, such as different weaves, density, elasticity, etc. Additionally, the bootie 200 may be made from any one or a combination of elastic or stretchable materials, including, but not limited to: woven synthetic fibers, polyurethane, nylon, cotton, spandex, neoprene, and other natural and synthetic materials. The bootie 200 may be disposed in the forefoot region 102, midfoot region 104, and/or heel region 106 of the footwear 100. However, other arrangements and configurations are contemplated, such as including a partial bootie structure in some or all of the forefoot region 102, midfoot region 104, and/or heel region 106 of the upper 110 and the sole structure 112.

In some examples, the bootie 200 may include a strap system 210. In an exemplary embodiment, the strap system 210 may include a plurality of strap members 212-220. In one embodiment, the plurality of strap members 212-220 may include woven textile straps. In an exemplary embodiment, the plurality of strap members 212-220 may be configured to distribute the load associated with supporting a foot of a wearer. In particular, each of the plurality of strap members 212-220 provides a system for sizing the interior portion of the bootie 200 receiving the wearer's foot such that by tightening the lace 113, the plurality of strap members 212-220 tighten around the bootie 200, and the user's foot to size the bootie 200 appropriately to the wearer's foot.

The strap members 214, 220 may be disposed on opposite sides of bootie 200. In one example, the strap members 214, 220 may be positioned on a lateral side 107 and a medial side 108 of the bootie 200. In one example, as shown in FIG. 3A, the bootie 200 may include eight strap members 214 and two strap members 220 total disposed on each side of bootie 200.

The strap members 218, 220 may be configured to support an arch and heel of a foot of a wearer. In particular, the strap members 218, 220 can be configured to tighten the portion of the bootie 200 around the wearer's foot in the heel region. The strap member 218 can be oriented in a horizontal direction such that it extends around the wearer's foot near the user's ankle. Whereas the strap member 220 can be configured to extend in a vertical direction and can be configured to interconnect to the horizontally extending strap 218 through slot or opening 224 in the vertical strap 220. Additionally, a portion of the strap 218 can extend vertically and can include a slot 222 for receiving the lace 113. In this way, when the wearer pulls the lace 113 tight, the straps 218 and 220 tighten around the wearer's ankle in the heel region 106 of the footwear 100. This configuration can advantageously provide for a heel region tightening system to secure the bootie 200 and ultimately the heel of the wearer's foot within the footwear 100.

By increasing the tension in lace 113, the bootie 200 is pulled into contact around the wearer's foot. As the bootie 200 is pulled into contact with the wearer's foot, the tension in the lateral side 107 and the medial side 108 of the outer covering 101 may be increased so as to draw the lateral side 107 and medial side 108 inward to some degree. Similarly, by decreasing the tension in lace 113, the bootie loosens around the wearer's foot. Subsequently the tension in the lateral side 107 and the medial side 108 may be decreased so as to provide additional volume for the foot within the upper 110. This general configuration provides, therefore, a mechanism for adjusting the fit of the upper 110 and for accommodating various foot dimensions.

Each of the strap members 214, 218 are provided with slots or openings 222 for receiving the lace 113. The lacing holes 222 can be formed through distal end portions of straps 214, 216. As shown in FIG. 3B, the opposite ends of the straps 214 can be secured to a lower portion of the bootie 200 on a seam 219 forming the base 221 of the bootie 200. In particular the ends of the straps 214 can be stitched to the bottom of the bootie 200. The lacing holes 222 can be configured to receive the lace 113. The lace 113 runs through the plurality of lacing holes 222. The lace 113 may also be disposed near tongue-like portion 226. The tongue-like portion 226 extends longitudinally along upper 110 and is positioned to contact the instep area of the foot. The lace 113 extends over tongue-like portion 226 and through the lacing holes 222 formed on both the lateral side 107 and medial side 108 of the footwear 200.

The strap members 214, 220 can also be connected by a strap 211 extending along the midfoot region 104 of the shoe. Strap 211 can be fixed to the bootie 200 by stitching. Strap 211 provides a guiding mechanism for straps 214, 218. In particular, a series of stitching 228 can be provided on strap 211 for guiding straps 214, 218 on the bootie 200. The stitching 228 can provide for slots along the strap 211 for receiving the straps 214, 218. As shown in FIG. 3A, the slots formed by the stitching 228 can be formed such that the straps 214 are positioned at an angle on the bootie 200 to property position the segments 103 on the footwear 100.

Strap 210 can also connect to strap 218, which can wrap around the heel region of the users foot. Strap 218 can also connect to a strap member 220 near the heel region 106. Additionally strap member 216 can be located in the forefoot region 102 of the shoe and can be configured to connect to straps 214, 218 via lace 113. With this arrangement the user can tighten lace 113 thereby pulling the strap members 212-220 inward and up from the bottom of the bootie 200 to secure the footwear 100 onto the user's foot. It follows that the lace 113 allows the article of footwear 100 to tighten around the foot of a wearer.

In other embodiments, the bootie 200 may include more or less strap members 212-218. In addition, the strap members 212, 214, and 218 can be firmed without any connecting material between each of the strap members 212, 214, and 218, or the plurality of strap members 212, 214, and 218 may be connected to each other using a webbing material. The bootie structure 200 can also be provided with a rear loop 229 for the user to grasp when placing the footwear onto his/her foot.

To assemble the segments 103 to the bootie 200, the inner parallel slots 136 of the toe segment 103*c* can be aligned with the parallel slots 109 on the front surface 138 of an adjacent inner segment 103*b*. Straps 214 (shown in FIG. 3A) can be threaded or weaved through the parallel slots 109 in the front portion and the inner parallel slots 136 on the inner connection surface 111 of the segment 103*b* and the toe segment 103*a*. This continues for each segment 103 until each strap 214 located on the bootie 200 is placed in a set of the parallel slots 109 and a set of the inner parallel slots 136 for an adjoining pair of segments 103 corresponding to the particular strap 214.

For example, strap 214-1 can be first placed through the lower one of the parallel slots 109 on the segment 103*b*-1 and then placed through the lower one of the inner parallel slots 136 on the segment 103*a*. The strap 214-1 is then fed through the upper one of the inner parallel slots 136 on segment 103*a* and then through the upper one of the parallel slots 109 of the segment 103*b*-1. Strap 214-2 can be first placed through the lower one of the parallel slots 109 on the segment 103*b*-2 and then placed through the lower one of the inner parallel slots 136 on the segment 103*b*-1. The strap 214-2 is then fed through the upper one of the inner parallel slots 136 on segment 103*b*-1 and then through the upper one of the parallel slots 109 of the segment 103*b*-2. Strap 214-3 can be first placed through the lower one of the parallel slots 109 on the segment 103*b*-3 and then placed through the lower one of the inner parallel slots 136 on the segment 103*b*-2. The strap 214-3 is then fed through the upper one of the inner parallel slots 136 on segment 103*b*-2 and then through the upper one of the parallel slots 109 of the segment 103*b*-3. Strap 214-4 can be first placed through the lower one of the parallel slots 109 on the segment 103*b*-4 and then placed through the lower one of the inner parallel slots 136 on the segment 103*b*-3. The strap 214-4 is then fed through the upper one of the inner parallel slots 136 on segment 103*b*-3 and then through the upper one of the parallel slots 109 of the segment 103*b*-4. Strap 214-4 can be first placed through the lower one of the parallel slots 109 on the segment 103*b*-4 and then placed through the lower one of the inner parallel slots 136 on the segment 103*b*-3. The same technique can be applied on each segment 103 and on each of the lateral side and the medial side of the footwear 100.

Additionally, the strap 220 of bootie 200 can be weaved through the parallel slots 109 on the heel segment 103*c* and the inner parallel slots 136 on the adjacent segment 103*b*-4 in a similar fashion. In particular, each strap 220 can be first placed through the lower one of the parallel slots 109 on one side the heel segment 103*c* and then placed through the lower one of the inner parallel slots 136 on that side of the segment 103*b*-4. The strap 220 is then fed through the upper one of the inner parallel slots 136 on the adjacent segment 103*b*-4 and then through the upper one of the parallel slots 109 on the heel segment 103*c*.

Straps 214, 218 of the bootie 200 can be provided on each of the lateral side 107 and medial side 108 and weaved through each of the segments 103 of the footwear 100. This results in each of the segments 103 being flexibly connected and thereby forming outer covering 101 of the footwear 100.

Figure 4:
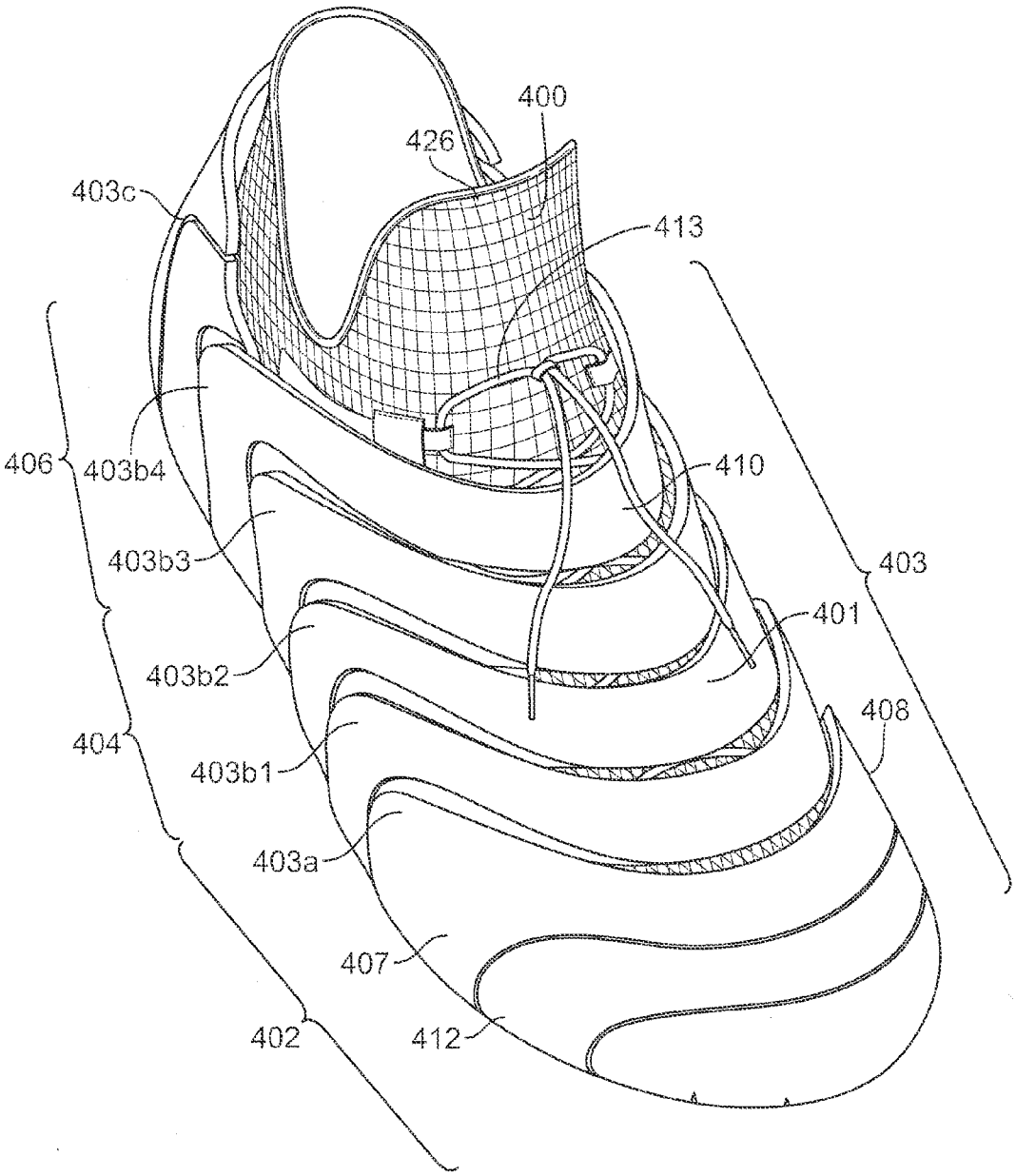
FIG. 4 is a top front lateral perspective view of an article of footwear according to another example.

FIG. 4 shows an alternative embodiment, where like reference numerals refer to like components. Footwear 400 includes bootie 426 and lace 413, a lateral side 407, and a medial side 408. The footwear 400 is similar to the embodiment shown in FIGS. 1A-2C, however in this embodiment, the segments 403 can be formed of different materials to provide for a customizable outer covering 401. Specifically, in this embodiment, the material forming each segment 403 can be optimized based on the particular user or activity of the user. Each segment 403*a*, 403*b*1, 403*b*3, 403*b*4, and 403*c* can be formed of a different material and or formed of different thicknesses to provide for varying footwear properties. For example, the toe segment 403*a* and the heel segment 403*c* may be formed of a tough leather, a synthetic leather, or a rubber material that imparts a relatively high degree of wear-resistance, whereas portions of the middle segments 403*b*1-403*b*4 may be formed of a textile material that provides greater flexibility or air-permeability. This provides for a footwear 400 that can be tuned according to the user's activity or preferences.

For example, the segment 403*b*4 can be formed of a more elastic and flexible material near the opening for receiving the user's foot to provide a more elastic opening portion to arrange for an easier insertion of the user's foot. Segment 403*b*3 can be formed less elastic than segment 403*b*4, and segments 403*b*2, 403*b*1 can be formed progressively less elastic than each adjacent segment extending from the heel region 406 through midfoot region 404 to the forefoot region 402 to provide for the desired comfort and stiffness of the upper 410 and sole portion 412. Heel segment 403*c* can be formed less elastic than segments 403*b*1, 403*b*3, 403*b*4. However, different arrangements are possible. For example, each segment material can be selected based on the user's preferences and the user's foot, physical size, ability, strength, and activity of the user. In this way, each segment 403 can be customized based on the particular user and the particular sport or activity of the user.

Figure 5A:
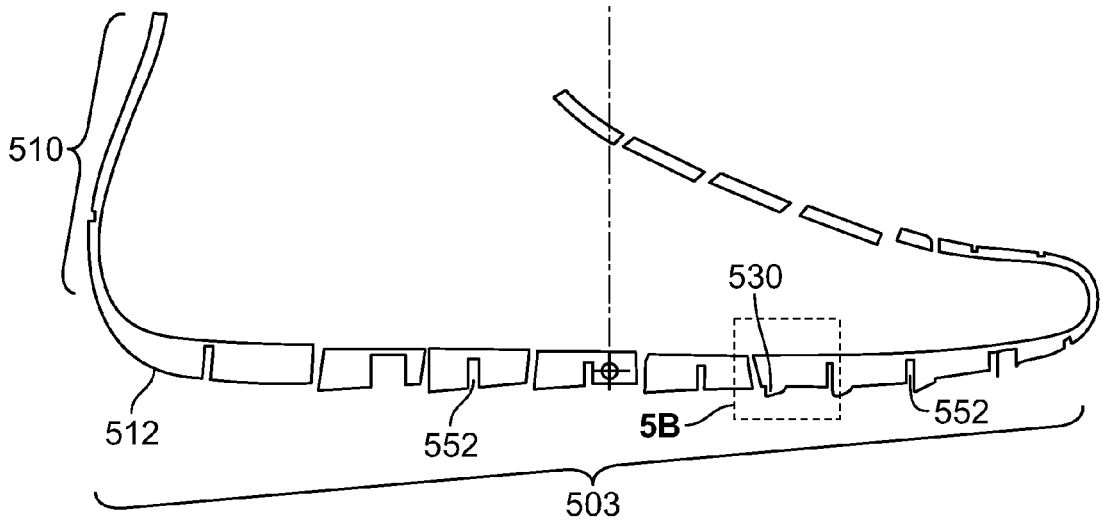
FIGS. 5A and 5B depict an exemplary fraction element on a sole structure.
Figure 5B:
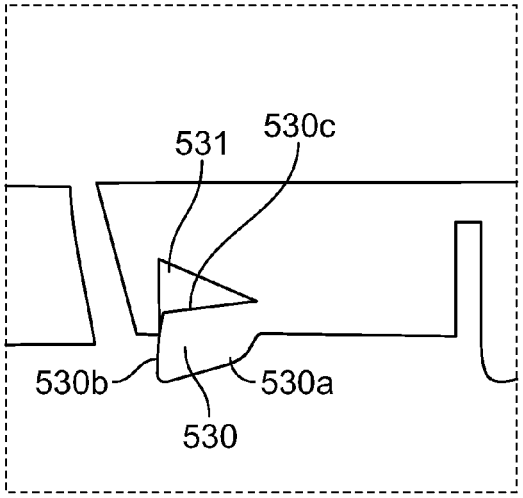

FIG. 5A depicts a cross-sectional view of an alternative arrangement of segments, and FIG. 5B shows an enlarged portion of FIG. 5A. Segments 503 and the footwear 500 can be formed and arranged in accordance with the other embodiments described herein. However, as shown in FIGS. 5A and 5B, the deflection elements 530 can be added to the bottom of the segments 503 forming the tread of the shoe to provide for traction in softer terrain such as grass or dirt.

The deflection elements 530 can be formed of a flap of material and can be formed to extend from the bottom surface of the segments 503 due to the elastic nature of the material forming the segments 503. One or more of the segments 503 can be formed with one or more deflection elements 530 depending on the desired amount of additional traction. Additionally, one or more of the segments 503 can be provided with one or more transverse sipes 552 that extend at least partially between the lateral and medial sides of the footwear 100 to obtain the desired level of fraction and articulation.

As shown in FIG. 5B, the cross-section of the deflection elements 530 can be formed with three sides 530*a*, 530*b*, 530*c*. The intersection of the sides 530*a* and 530*b* can form a pointed portion to assist in gripping terrain encountered by the user. A corresponding recess 531 can be provided in the segments 503 to receive the deflection elements 530 when the user encounters a harder surface. The recess 531 can be formed to correspond in shape and size with the deflection elements 530. Thus, when the user encounters a harder surface, the deflection elements 530 will retract into the recess 531 of the segment 503.

The deflection elements 530 and corresponding recesses 531 can be formed integrally with the segments 503 forming the upper 510 and the sole structure 512 of the footwear. The deflection elements 530 can be formed of a certain elasticity such that the elements 530 remain biased outward in the extended position as shown in FIG. 5*b* when the user is in softer terrain or irregular terrain and retracted into the recess 531 when the user encounters a hard surface.

The deflection elements 530 can, thus, provide for a more versatile sole structure by either extending or retracting depending on the particular terrain encountered by the user. When the deflection elements are retracted into the sole structure, the footwear is better suited to grip a flat surface. When the deflection elements are extended such as when the wearer encounters a softer or irregular terrain, the tips will extend because of the elastic properties of the deflection elements, and the deflection elements will better grip the softer or irregular terrain. During use of the shoe over softer and irregular terrain, the deflection elements 530 provide for traction by remaining extended out from the tread.

Figure 6A:
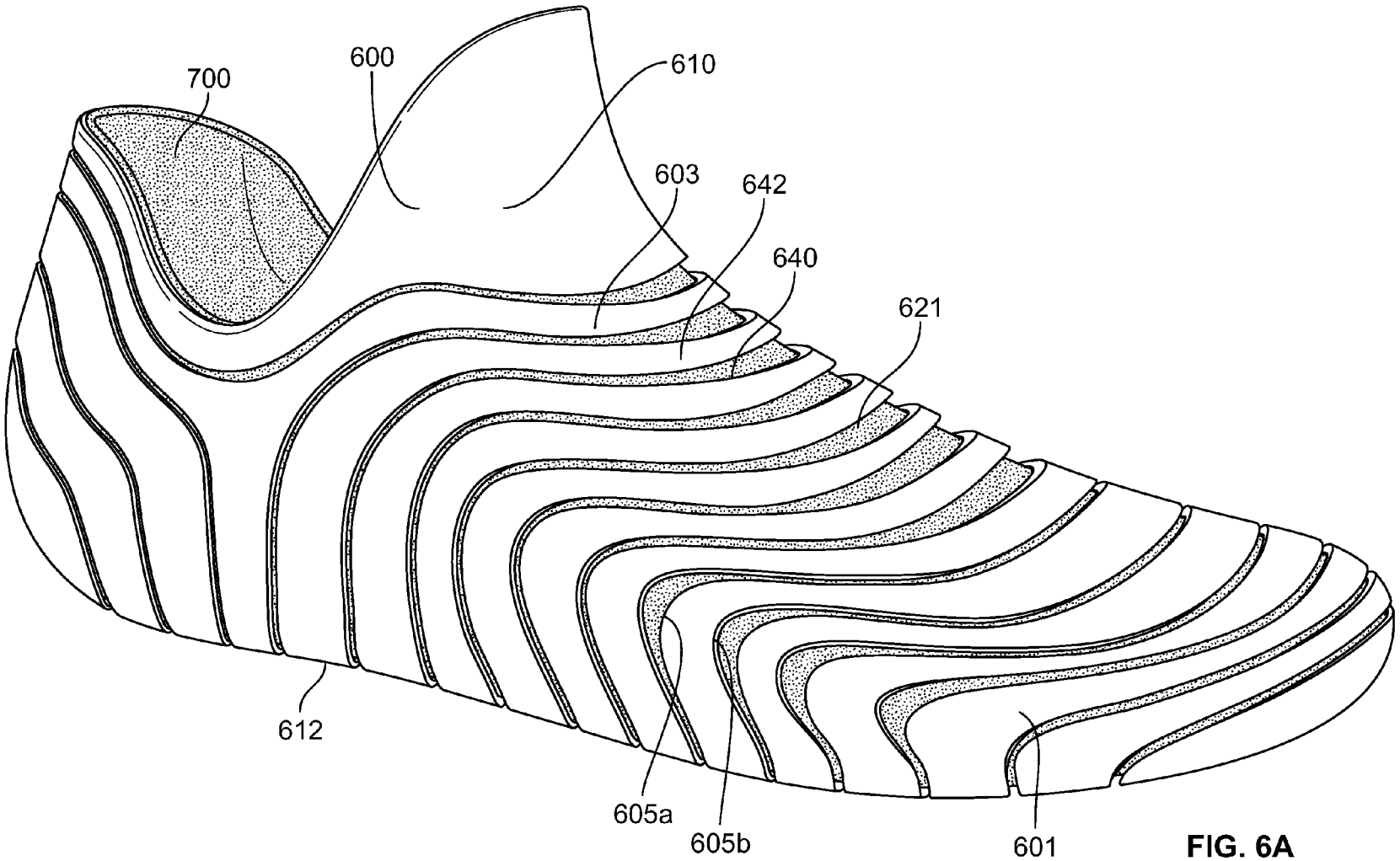
FIG. 6A is a lateral side perspective view of an article of footwear according to another example.
Figure 6B:
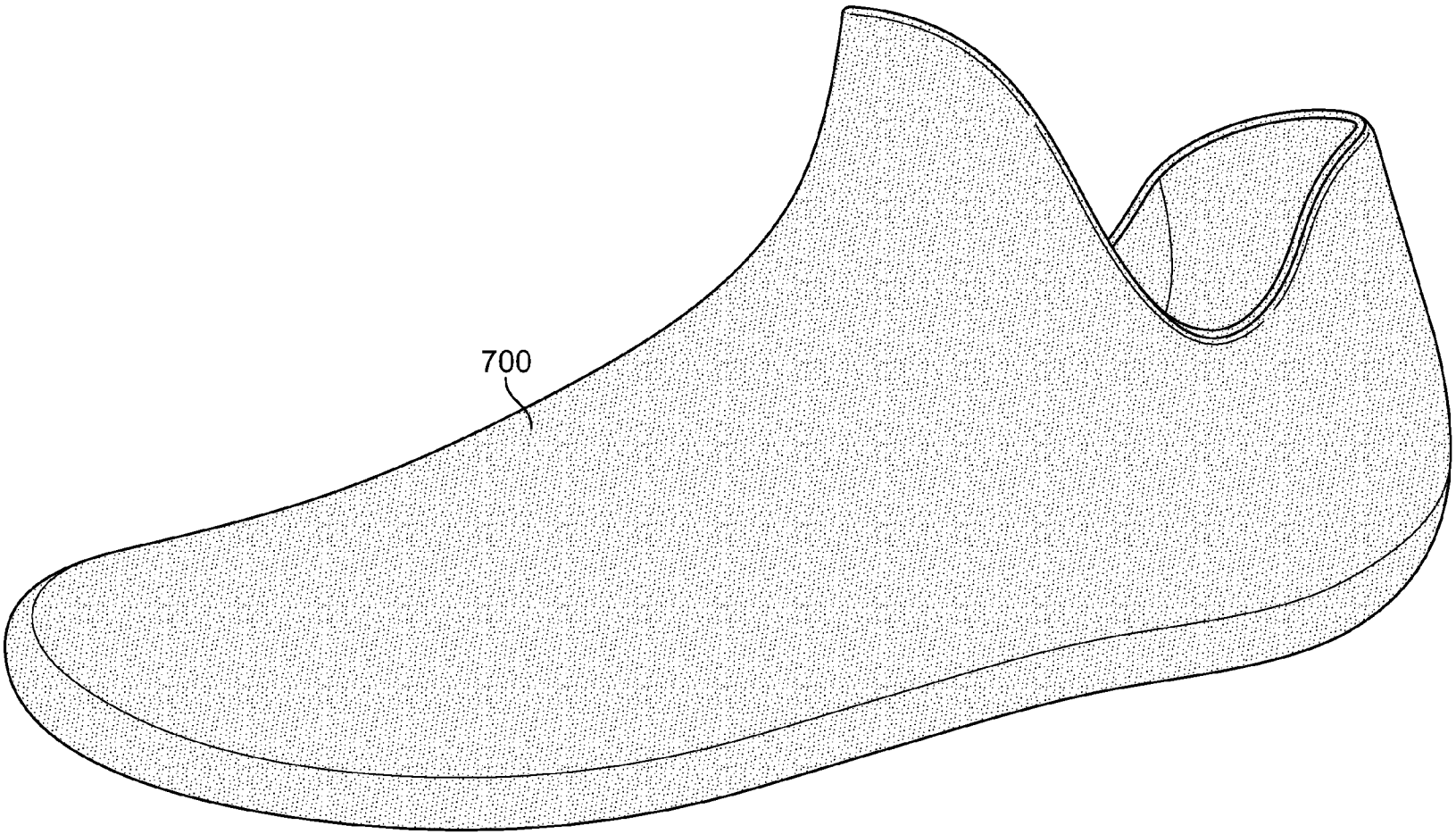
FIG. 6B is a medial side perspective view of bootie structure from the article of footwear of FIG. 6A.

FIGS. 6A and 6B depict another alternative example, where the footwear 600 is formed of individual segments 603 molded to a bootie 700. In this embodiment, the bootie 700 can be formed of a similar material as the bootie 700, such as a knit material. However, the bootie 700 can be formed without straps to secure the segments 603 to the bootie 600. Instead the segments 603 can be direct injection molded on the outside portion of the knit structure forming the bootie 700. This example may provide a sole structure 612 that is more even along the bottom of the footwear 600.

The footwear 600 can be provided with a number of segments 603 and a number of gaps 621 between each of the segments 603. The segments 603 and the gaps 621 provide for the desired articulation of the segments 603 and ultimately the footwear 600 during use on the user's foot. The gaps 621 are included in the upper structure 610 and in the sole structure 612 of the outer covering 601. In this particular example, the footwear 600 is provided with approximately 18 segments 603 that form the footwear. However, the number of segments will vary according to the sizing and desired flexibility of the footwear 600.

To injection mold the segments 603 on the outside portion of the knit structure forming the bootie 700, the bootie 700 can be placed onto a 3D last and a separate mold structure can be placed over the 3D last and bootie 700. The material forming the segments can be injection molded into the mold and over the top and around the bootie 700 and the last. The material will then bond to the bootie 700 to form the footwear 600 in the shape of the last and the bootie 700. Several gaps can be formed in the mold to provide areas for the material to flow into the shape of the segments 603 on the footwear 600. In another example, each segment can be separately injection molded in the same mold structure by providing a plurality of openings in the mold for the material to be injected into the mold. In yet another example, a sprue line can be provided to channel the material to the individual areas inside the mold that are formed in the shape of the segments. After the formed structure is removed from the mold the excess material could be snipped off.

In this embodiment the segments 603 can be provided with several points of curvature around the bootie to obtain the desired articulation properties of the footwear 600. For example, certain segments 603 can be formed with a concave portion 640 in a top region of the upper 610. Additionally, certain segments 603 can each be provided with a corresponding outwardly curved or convex portion 642. The convex portions 642 of the segments 603 can be received in corresponding concave portions 640 of the segments 603. Additionally, certain segments 603 can be provided with an additional convex portion 605*a* and a corresponding concave portion 605*b* for receiving adjacent segments 603. Similar to the above embodiment, the segments 603 can each encircle the knit material 700. The footwear 600 can be provided with more or less segments 603 depending on the desired properties.

To form the bootie, first the bootie 700 is formed of a knit material, which can be formed by weaving or any other known method. The knit material can provide for an opening for receiving the user's foot. The segments 603 are then injection molded over the bootie such that gaps 621 are formed between the segments 603.

Figure 7A:
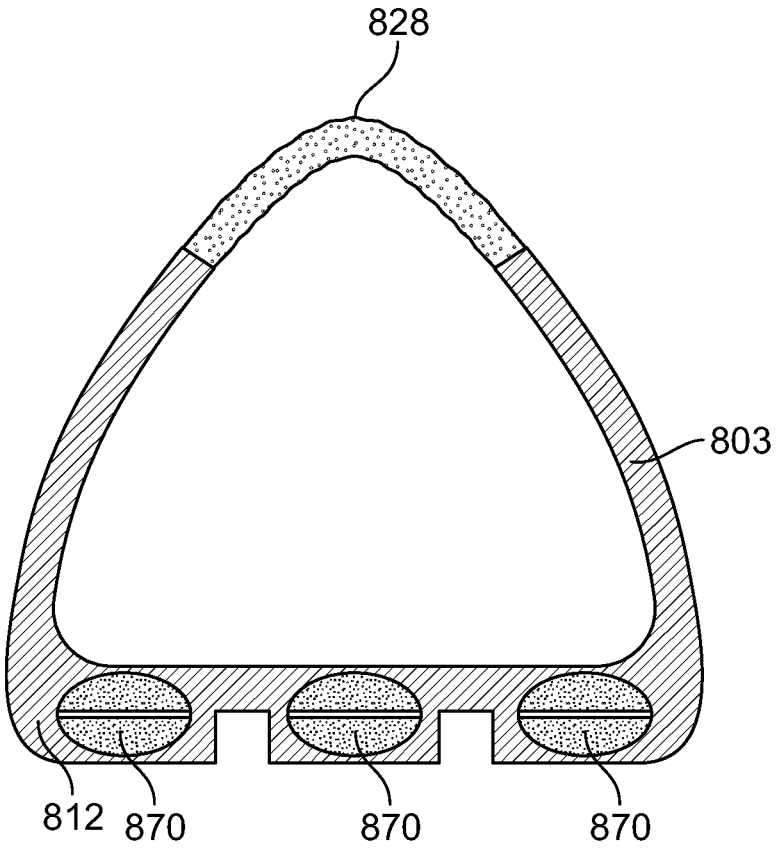
FIGS. 7A and 7B are cross-sectional views of example segments that can be used to form footwear.
Figure 7B:
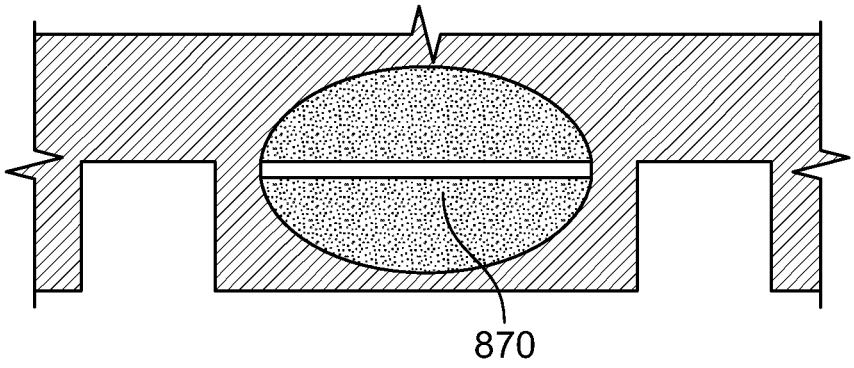

FIGS. 7A and 7B show alternative embodiment of a segment 803. Segment 803 can be formed similar to the other embodiments disclosed herein; however, segment 803 can be provided with impact absorbing elements 870 to provide for additional impact force attenuation in the sole structure 812. Additionally the top portion 828 of the segment 803 can be formed more elastic than the remainder of the segment 803. The elastic elements can be fluid filled chambers or bladders containing any gas (e.g. air) or can be formed of any solid elastic material or polymers the provide for the desired impact force attenuation in the sole structure such as rubbers, foams, etc.

In other alternative embodiments, a separate midsole structure could be added to the bootie if additional cushioning in the footwear is desired. The midsole could be bonded to the bootie, or could be formed as a drop-in type midsole—formed as a thick sock liner, or could be formed as a stock-fitting type midsole. In the stock-fitting type example, the midsole could be used to secure the segments together and the bootie could be glued onto the midsole. Alternatively, the midsole could be provided as a spine element to give the footwear more freedom of movement.

In other alternative embodiments, the segments can be formed of different shapes including shapes having more or less pointed curves, flanges formed on the front of the segment instead of the rear portion of the segment, different sized and shaped curves on the lateral side and the medial side of the of the footwear. The segments could also be formed of varying widths where some segments are formed wider than others. The outer covering may be formed of a different number of segments on the lateral side and the medial side such that two or more the segments are fused together on one side, but formed separated on the other side. Additionally, other mechanical methods of connecting the segments together are contemplated, for example ball and socket, bayonet-type, or press-fit type connections can be used to connect the segments to one another.

In another example, the footwear could be formed by a rapid prototyping process, 3D printing process, laser sintering or additive manufacturing process instead of molding the footwear. This process can utilize lasers and a powder material to form the footwear and provides a technique where the footwear can be formed as a single and unitary structure. With the use of an additive manufacturing process undercuts are easier to deal with and the overlaying of segments can be avoided.

An additive manufacturing process may provide for a customization option so that the shoe can be customized to the individual's foot. For example, an individual customer's foot can be scanned under the appropriate conditions for the use of the shoe (e.g., running, walking, etc.) In this way, a scan of the user's foot can be taken to get the proper sizing and a material configuration. Taking this scan, the footwear can be formed by a rapid prototyping operation.

An article of footwear may comprise a plurality of individual segments. Each of the plurality of segments may form a portion of a combined upper and a sole structure of the article. Each of the segments may define a space bounded by the segment, and the segments may be arranged such that the spaces define a generally foot-shaped interior volume. A bootie may be contained within and line the foot-shaped interior volume of the article, and may interconnect the plurality of segments. The interconnected plurality of segments may be independently moveable with respect to one another. Each segment may comprise a top portion, a pair of side portions, and a bottom portion. The side portions may comprise a rearward section and a forward section. The top portions and the side portions of the plurality of interconnected segments may define an upper portion of the combined upper and sole structure and the bottom portions of the plurality of interconnected segment, define a sole portion of the combined upper sole structure. The side portions of at least one of the segments may each comprise a lower section, a middle section, and an upper section. The middle section may extend in a rearward direction from the lower section and the upper section. The middle section may include a first pair of slots formed on an inner surface.

A pair of slots may receive a strap on the bootie structure, and the strap may secure the segment to the bootie structure. The slots may provide a passageway inside the segment such that a portion of the strap extends along the passageway inside of the segment. A middle section of at least one of the segments may further comprise a second pair of slots. The second pair of slots may be configured to receive a strap located on the bootie. The first pair of slots on a segment and the second pair of slots on an adjacent segment may be configured to be aligned and to receive a common strap located on the bootie. At least one of the segments may be provided with a deflection element on a portion of the segment forming the sole structure, and the deflection element may be configured to retract into a corresponding recess formed on the segment.

The bootie structure may comprise a plurality of straps for securing the plurality of segments to the bootie structure. The plurality of straps further may comprise loops configured to receive a lace, with the straps together and the lace providing a tightening mechanism to adjust the footwear according to the size of the user's foot.

In another embodiment, an article of footwear may comprise a plurality of segments, each segment comprising an upper portion, a pair of side portions, and a bottom portion. The side portions may comprise a rearward section and a forward section. The upper portions, the side portions, and the bottom portions may together define a combined upper and sole structure. At least some of the side portions may comprise a first pair of slots and a second pair of slots. The article of footwear can include a bootie lining the plurality of segments. The bootie may interconnect the plurality of segments with a plurality of straps extending from the bootie. Each strap may extend through each first pair of slots and each second pair of slots on the at least some of the side portions such that the plurality of segments are independently moveable with respect to one another. The side portions of at least one of the segments may each comprise a lower section, a middle section, and an upper section, and the middle sections may extend in a rearward direction from the lower section and the upper section. The middle sections may include the first pair of slots formed on the inner surface. The first pair of slots may be connected inside the segment such that a portion of each strap is configured to be located within a portion of the segment. The middle sections of the segments may further comprise the second pair of slots formed to extend through an exterior surface. The second pair of slots may receive a strap located on the bootie therethrough. The first pair of slots on a segment and the second pair of slots on an adjacent segment may be aligned to receive a common strap located on the bootie. At least one of the segments may be provided with a deflection element on a portion of the segment forming the sole structure and wherein the deflection element is configured to retract into a corresponding recess formed on the segment. The plurality of straps may further comprise a loop for receiving a lace, and the straps together with the lace provide for a tightening mechanism to adjust the footwear according to the size of the user's foot.

In another embodiment, a method for forming an article of footwear may comprise providing a plurality of segments to form a combined upper structure and sole structure, providing a bootie structure to form an inner liner in the combined upper and sole structure, and interconnecting the plurality of segments with the bootie structure such that the plurality of segments are independently moveable with respect to one another. The method may further comprise forming each segment with an upper portion, a pair of side portions, and a bottom portion. The side portions may comprise a rearward section and a forward section. The upper portions and the side portions may together define the upper structure and the bottom portions may together define the sole structure. The method may further comprises forming a first pair of slots on an inner surface of each of the segments, placing a strap on the bootie structure through the first pair of slots to secure the segment to the bootie structure, and forming a second pair of slots on an exterior surface of each segment. The method may further comprise placing a strap on the bootie structure through the second pair of slots and aligning the first pair of slots of a segment and the second pair of slots on an adjacent segment and placing a common strap located on the bootie through the aligned first pair of slots and second pair of slots.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims. Any and all permutations of features described above, as well as embodiments omitting one or more features described above, are within the scope of the invention.

We claim:

1. An article of footwear comprising:

a plurality of individual segments, wherein each of the plurality of segments forms a portion of a combined upper and a sole structure of the article, each of the segments defines a space bounded by the segment and the segments are arranged such that the spaces define a generally foot-shaped interior volume, each of the plurality of segments includes a first pair of slots; and a bootie contained within and lining the foot-shaped interior volume of the article, the bootie interconnecting the plurality of segments, and wherein the interconnected plurality of segments are independently moveable with respect to one another; and a plurality of straps disposed on the bootie and interconnecting the plurality of segments to the bootie using the first pair of slots.

2. The footwear of claim 1 wherein each segment comprises a top portion, a pair of side portions, and a bottom portion, wherein each of the side portions comprises a rearward section and a forward section, and wherein the top portions and the side portions of the plurality of interconnected segments define an upper portion of the combined upper and sole structure and the bottom portions of the plurality of interconnected segments, define a sole portion of the combined upper and sole structure.

3. The footwear of claim 2 wherein the side portions of at least one of the segments each comprises a lower section, a middle section, and an upper section and wherein the middle section extends in a rearward direction from the lower section and the upper section and wherein the middle section includes the first pair of slots formed on an inner surface.

4. The footwear of claim 3 wherein each of the first pairs of slots receive a strap of said plurality of straps on the bootie and wherein the strap secures the segment to the bootie and wherein the slots provide a passageway inside the segment such that a portion of the strap extends along the passageway inside of the segment.

5. The footwear of claim 4 wherein a middle section of at least one of the segments further comprises a second pair of slots.

6. The footwear of claim 5 wherein the second pair of slots are configured to receive a strap located on the bootie.

7. The footwear of claim 6 wherein the first pair of slots on a segment and the second pair of slots on an adjacent segment are configured to be aligned and to receive a common strap located on the bootie.

8. The footwear of claim 1 wherein at least one of the segments is provided with a deflection element on a portion of the segment forming the sole structure and wherein the deflection element is configured to retract into a corresponding recess formed on the segment.

9. The footwear of claim 1 wherein the plurality of straps further comprise loops configured to receive a lace and wherein the straps together with the lace provide for a tightening mechanism to adjust the footwear according to the size of the user's foot.

10. An article of footwear comprising:

a plurality of segments, each segment comprising an upper portion, a pair of side portions, and a bottom portion, wherein each of the side portions comprises a rearward section and forward section, wherein the upper portions, the side portions, and the bottom portions together define a combined upper and sole structure, wherein at least some of the side portions comprise a first pair of slots and a second pair of slots;

a bootie lining within the plurality of segments; and wherein the bootie interconnects the plurality of segments with a plurality of straps extending from the bootie, wherein each strap of the plurality of straps extends through a different one of the first pairs of slots and through a different one of the second pairs of slots such that the plurality of segments are independently moveable with respect to one another.

11. The footwear of claim 10 wherein the side portions of at least one of the segments each comprises a lower section, a middle section, and an upper section and wherein the middle section extends in a rearward direction from the lower section and the upper section and wherein the middle section includes at least one of the first pairs of slots formed on the inner surface.

12. The footwear of claim 11 wherein each first pair of slots are connected inside each respective segment such that a portion of each strap is located within a portion of the segment.

13. The footwear of claim 12 wherein each second pair of slots extends to an exterior surface.

14. The footwear of claim 13 wherein the first pair of slots on a segment and the second pair of slots on an adjacent segment are aligned and receive a common one of the plurality of straps located on the bootie.

15. The footwear of claim 11 wherein at least one of the segments is provided with a deflection element on a portion of the segment forming the sole structure and wherein the deflection element is configured to retract into a corresponding recess formed on the segment.

16. The footwear of claim 11 wherein the plurality of straps further comprises a loop for receiving a lace and wherein the straps together with the lace provide for a tightening mechanism to adjust the footwear according to the size of the user's foot.

17. A method for forming an article of footwear comprising:

providing a plurality of segments to form a combined upper structure and sole structure;

forming each segment with an upper portion, a pair of side portions, and a bottom portion, wherein the side portions comprise a rearward section and a forward section; wherein the upper portions and the side portions together define the upper structure and the bottom portions together define the sole structure;

forming a first pair of slots on an inner surface of each of the segments;

providing a bootie structure to form an inner liner in the combined upper and sole structure; interconnecting the plurality of segments with the bootie structure such that the plurality of segments are independently moveable with respect to one another; and placing a strap on the bootie structure through one of the first pair of slots to secure the segment to the bootie structure.

18. The method of claim 17 further comprising forming a second pair of slots on an exterior surface of each segment.

19. The method of claim 18 further comprising placing a strap on the bootie structure through one of the second pair of slots.

20. The method of claim 19 further comprising aligning the first pair of slots of a segment and the second pair of slots on an adjacent segment and placing a common strap located on the bootie through the aligned first pair of slots and second pair of slots.

* * * * *